US009074149B2

(12) United States Patent
Tsang et al.

(10) Patent No.: US 9,074,149 B2
(45) Date of Patent: Jul. 7, 2015

(54) METHODS AND SYSTEMS FOR TREATING A GASIFICATION SLAG PRODUCT

(75) Inventors: Albert C. Tsang, Sugar Land, TX (US); Max W. Thompson, Bartlesville, OK (US); Rick Q. Honaker, Nicholasville, KY (US)

(73) Assignee: Lummus Technology Inc., Bloomfield, NJ (US)

( * ) Notice: Subject to any disclaimer, the term of this patent is extended or adjusted under 35 U.S.C. 154(b) by 1383 days.

(21) Appl. No.: 12/652,318

(22) Filed: Jan. 5, 2010

(65) Prior Publication Data

US 2010/0181537 A1 Jul. 22, 2010

Related U.S. Application Data

(60) Provisional application No. 61/146,189, filed on Jan. 21, 2009.

(51) Int. Cl.
*C10J 3/52* (2006.01)
*B03B 9/04* (2006.01)

(52) U.S. Cl.
CPC ... *C10J 3/52* (2013.01); *B03B 9/04* (2013.01); *C10J 2300/1631* (2013.01); *C10J 2300/1807* (2013.01)

(58) Field of Classification Search
CPC ..... C10J 3/52; C10J 2300/1807; C10J 2300/1631
USPC ..... 48/61
See application file for complete search history.

(56) References Cited

U.S. PATENT DOCUMENTS

| | | | | |
|---|---|---|---|---|
| 2,139,789 | A | 12/1938 | Wuensch | |
| 3,544,291 | A * | 12/1970 | Schlinger et al. | 48/206 |
| 3,957,458 | A | 5/1976 | Squires | |
| 3,971,638 | A * | 7/1976 | Matthews | 48/202 |
| 4,425,254 | A * | 1/1984 | Langhoff et al. | 252/373 |

(Continued)

FOREIGN PATENT DOCUMENTS

| | | |
|---|---|---|
| BE | 349201 | 2/1928 |
| CN | 2175027 Y | 8/1994 |

(Continued)

OTHER PUBLICATIONS

Perwitz, "Extraction of Coal form Tailings/Slurries by Cleaning in an Autogenous Dense Medium" Aufbereitungs-Technik, Verlag Fuer Aufbereitung, Wiesbaden, DE, vol. 34, No. 12, (Dec. 1, 1993), pp. 625-630, XP000401853.

(Continued)

*Primary Examiner* — Matthew Merkling
(74) *Attorney, Agent, or Firm* — Osha Liang LLP

(57) ABSTRACT

The current invention discloses a novel process and system to improve the quality of the slag product from a gasification process, thereby producing low-carbon marketable aggregate product. The inventive processes and systems employ a hindered-bed settler in conjunction with optional disengager and de-watering devices. A slag slurry stream from a gasification process is de-watered and the solids content is increased from less than 5% to greater than 30% via the de-waterer before being conveyed to a hindered-bed settler, wherein the carbon content is reduced from as much as 70% to less than 5%. Particles with a high carbon content are conveyed to a gravity settler, whereby they are concentrated and then recycled to the gasification reactor.

9 Claims, 3 Drawing Sheets

(56) References Cited

U.S. PATENT DOCUMENTS

| | | | | |
|---|---|---|---|---|
| 4,436,617 | A | 3/1984 | Moore et al. | |
| 4,465,496 | A | 8/1984 | Suggitt | |
| 4,508,542 | A | 4/1985 | Langhoff et al. | |
| 4,533,464 | A | 8/1985 | Smith et al. | |
| 4,946,476 | A * | 8/1990 | Najjar et al. | 48/197 R |
| 5,622,534 | A | 4/1997 | Andrus, Jr. | |
| 6,264,040 | B1 | 7/2001 | Mankosa et al. | |
| 6,425,485 | B1 | 7/2002 | Mankosa et al. | |
| 6,758,978 | B1 | 7/2004 | Bedell | |
| 6,953,123 | B2 | 10/2005 | Niititi | |
| 7,328,805 | B2 | 2/2008 | Price et al. | |
| 2003/0183137 | A1 | 10/2003 | Martin et al. | |
| 2003/0234227 | A1 * | 12/2003 | Niitti | 210/800 |
| 2008/0314823 | A1 * | 12/2008 | Kulick et al. | 210/521 |
| 2009/0120290 | A1 * | 5/2009 | Wallace et al. | 95/204 |
| 2010/0155309 | A1 * | 6/2010 | Niitti | 209/645 |

FOREIGN PATENT DOCUMENTS

| | | | |
|---|---|---|---|
| CN | 2476556 | Y | 2/2002 |
| DE | 2220132 | | 12/1973 |
| DE | 102005048960 | | 4/2007 |
| EP | 0101005 | | 2/1984 |
| EP | 0227197 | B1 | 2/1991 |
| EP | 0438822 | B2 | 3/1995 |
| FR | 2417326 | | 9/1979 |
| WO | WO03078013 | A2 | 9/2003 |
| WO | 2009/064529 | | 5/2009 |

OTHER PUBLICATIONS

PCT/US2010/020220 International Search Report (Form PCT/ISA/220) dated Aug. 16, 2010.

Second Office Action issued Sep. 2, 2013 (w/translation) in corresponding Chinese application No. 201080004948.4 (21 pages).

Third Office Action issued Feb. 18, 2014 (w/translation) in corresponding Chinese application No. 201080004948.4 (31 pages).

Rejection Decision (with translation) issued Jun. 25, 2014 in Chinese Patent Application No. 201080004948.4 (28 pages).

Notification of Reexamination issued Jan. 12, 2015 (w/translation) in corresponding Chinese application No. 201080004948.4 (31 pages).

"Development and Application of Teetered Bed Coal Separation Technology", Wang Jianjun et al., Coal Preparation Technology, Jun. 25, 2007, No. 3, 70-72.

* cited by examiner

METHODS AND SYSTEMS FOR TREATING A GASIFICATION SLAG PRODUCT

BACKGROUND

The present invention relates generally to a system and a process for improving the quality of gasification slag product. More particularly, the present invention relates to systems and processes for improving the quality of the slag product from a gasification process that converts a carbonaceous feedstock into desirable gaseous products such as synthesis gas.

The product of gasification is a reactive gas predominantly comprising carbon monoxide and hydrogen. This gas can be used as a fuel gas, or it can be chemically converted to other products, such as synthetic oil. During gasification, the inorganic portion of the coal forms a vitreous slag by-product, which comprises molten or partially-fused particles that come into contact with the furnace wall, flow downwards towards the bottom opening, or taphole, of the furnace, then out of the furnace. The slag then drops into a water bath where it is quenched, solidified, and broken up into a granular aggregate material. Typically, slag is removed from the water bath as a slurry.

Often, the slag produced as a byproduct of gasification processes does not meet market expectations, mainly because of high residual carbon content. Carbon content of the slag is often between 20-30%, sometimes as high as 70%, while less than 5% is normally required for the slag to be commercially marketable. Slag with a low carbon content can be used as aggregate for road or construction fill, concrete mix, roofing shingles, as sandblasting grit or for other applications.

Various processing methods have been instituted to improve slag quality and increase its marketability, such as the screening technology disclosed in U.S. Pat. No. 7,328,805, (incorporated herein by reference). However, some slag products may not present a certain size fraction showing the carbon content is predominant, and the above mentioned screening method is not beneficial for such slag.

Accordingly, there is a need for new technology that can improve the quality of slag product produced during gasification of carbonaceous feedstocks, such that the resulting slag product is marketable.

SUMMARY

The current invention discloses novel processes and systems that improve the quality of the slag product derived from a gasification process. To accomplish this, a hindered-bed settler is employed with an optional dewatering and water recycling unit. Hindered-bed settlers employ a counter-current water wash column to "float" lighter solid particles such as carbon, thereby separating these lighter particles from denser particles such as ash. The operation of the unit does require a generous amount of wash water flow to create the up-thrust. Dry solid feed or a slurry feed stream with high solid content is preferred so that the particles will pack together tighter in the hindered-bed settlers bed to generate a higher up-flow velocity between the particles, thereby reducing water consumption. A system to collect, clean, and re-use the wash water is often necessary to minimize net water usage and discharge Hindered-bed settlers have been used extensively in sand and mineral industries, as well as for separation of fine coal from shale, coal from sand, etc. Hindered-bed settlers are commercially-available and relatively inexpensive to purchase. However, such an apparatus has not been used in conjunction with a gasification process, or the upgrading of a gasification slag product. It is important to note that the present invention comprises more than utilizing a hindered bed settler in conjunction with a gasification system. An additional benefit of the invention includes increasing the overall carbon conversion efficiency of the gasification process by separating out slag particles containing a high carbon content, then returning these slag particles to the gasification reactor as fuel. In addition, the current invention reduces cost and environmental impact by recycling the water utilized in the hindered-bed settler.

Certain embodiments of the present invention provide a system for improving the quality of a slag product from a gasifier. The system generally comprises a hindered-bed settler for fluidizing and segregating the slag product into an overflow stream containing carbon particles and an underflow stream; a gravity settler for separating the overflow stream into carbon stream and wash water; and a recycle water tank for recycling the wash water. The wash water in the recycle water tank is recycled back into the hindered-bed settler and the carbon stream is recycled back into the gasifier. The hindered-bed settler may further comprises a vertical section; a conical section; a distributor there in between; and an opening at the bottom of the conical section. In this design, the slag product is fluidized in the vertical section by upward rising of the wash water distributed by the distributor and is therefore segregated into 1) the overflow stream at the top of the vertical section, and 2) the underflow stream at the bottom of the conical section. The heavy solids are settled from the underflow and removed from the hindered-bed settler via an outlet orifice. In this system, slag particles in the underflow stream have a lower carbon content than particles in the overflow stream, preferably a carbon content of less than 5%. Thus, the slag particles in the underflow stream represent a commercially viable product. The hindered-bed settler may further comprises a tap hole at the bottom of the conical section. The gravity settler may be, but is not limited to, a commercially-available inclined-plate lamella settler or thickener/clarifier unit.

Certain embodiments of the present invention provide a system for improving the quality of a slag product produced by a gasification reactor. The system generally comprises: a de-waterer for concentrating the slag product into a concentrated slag stream and a first overflow stream; a hindered-bed settler for fluidizing and segregating the concentrated slag stream into second overflow stream containing carbon particles and an underflow stream; a gravity settler for separating the first and second overflow streams into carbon stream and wash water; and a recycle water tank for storing the wash water from the gravity settler. The carbon stream is recycled back to the gasification reactor and the wash water in the recycle water tank is recycled back to the hindered-bed settler. In this system, the de-waterer may be a disengager comprising: a disengager vessel for settling and concentrating the slag product into concentrated slag stream and first overflow stream; a flow distributor for evenly distributing the slag across the disengager vessel; and an overflow weir for removing the first overflow stream from the disengager vessel. The concentrated slag stream is sent to the hindered-bed settler. The underflow stream in the hinder-bed settler has a carbon content less than 5%. The de-waterer may also be a spiral de-waterer comprising an open trough for that allows sedimentation of solids; a transportation spiral for removing and dewatering the solids; and a feed distributor for evenly spreading the slag into the open trough. In such a design, solids are continuously removed by the transportation spiral and dewatered by drainage in an upper part of the transportation spiral prior to being sent to the hindered-bed settler.

Certain embodiments of the present invention provide a process for improving the quality of a slag product from a gasifier. The process generally comprises: fluidizing and segregating the slag in hindered-bed settler into an overflow stream containing carbon particles and an underflow stream; separating the overflow stream in a gravity settler into a carbon stream and wash water; conveying the wash water to a recycle water tank; recycling the water from the recycle water tank for reuse in the hindered-bed settler, and recycling the carbon stream back to the gasification reactor.

Certain embodiments of the present invention provide a process for improving the quality of a slag product from a gasifier. The process generally comprises: concentrating the slag in a de-waterer into a concentrated slag stream and a first overflow stream; fluidizing the concentrated slag stream in a hindered-bed settler, and segregating said stream into second overflow stream containing carbon particles and an underflow stream; separating the first and second overflow streams into a carbon stream and wash water using a gravity settler; conveying the wash water from gravity settler into a recycle water tank; recycling the carbon stream back to the gasification reactor, and recycling the water from recycle water tank for reuse in the hindered-bed settler.

BRIEF DESCRIPTION OF THE DRAWINGS

For a more detailed description of the embodiments of the present invention, reference will now be made to the accompanying drawings, wherein.

DETAILED DESCRIPTION

The following detailed description of various embodiments of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. Thus, the following detailed description is not intended to be limit the scope of the invention to only the embodiments specifically disclosed. The true scope of the present invention is defined only by the appended claims, along with the full scope of equivalents to which such claims are entitled.

Figure 1:
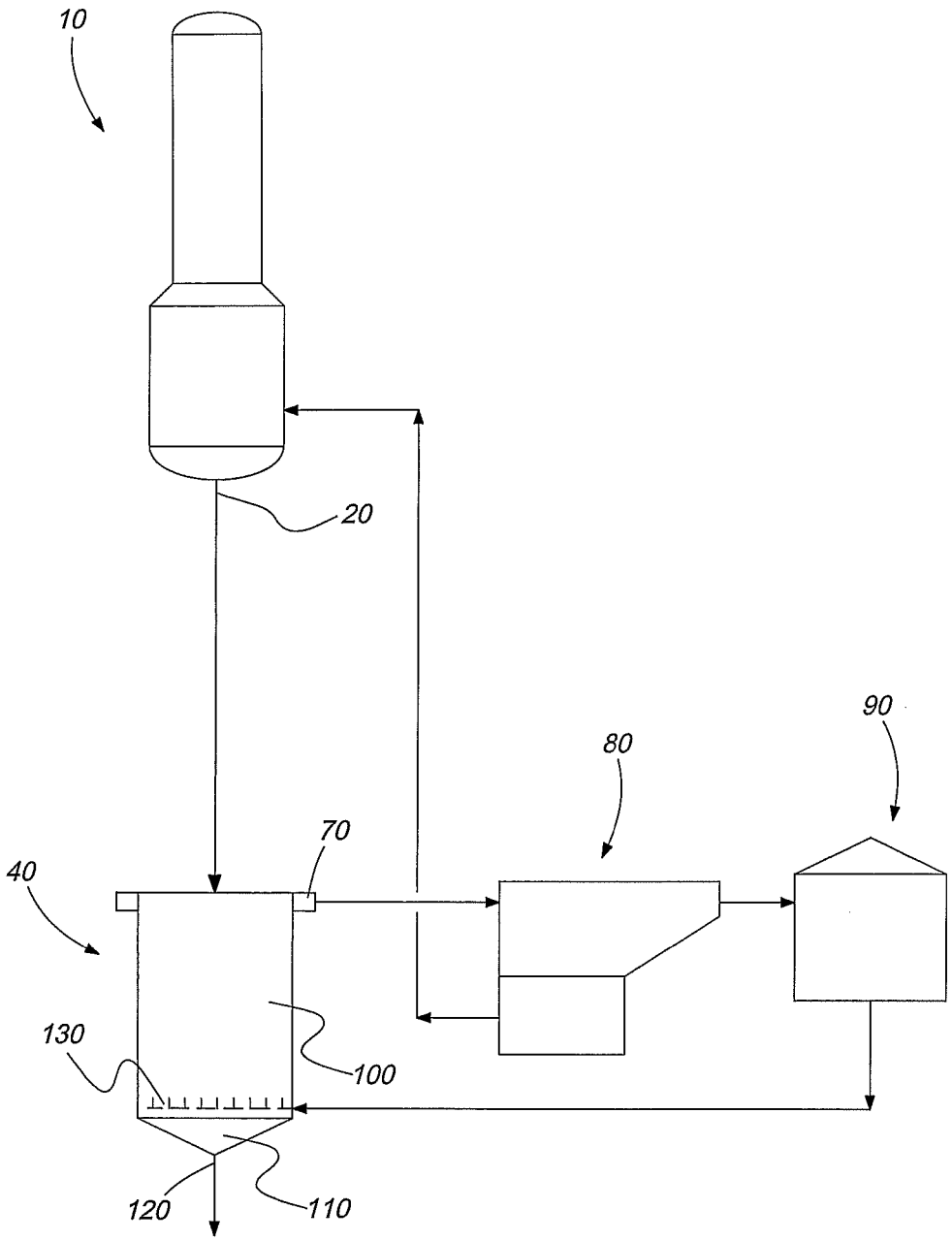
FIG. 1 is a schematic representation of one embodiment of the present invention.

According to one embodiment as shown in FIG. 1, there is illustrated a diagram of a slag handling, beneficiation, carbon recovery/concentration/recycling process and system for the slag produced in a slagging gasifier. Further referring FIG. 1, the system comprises primarily a hinder-bed settler (hereinafter HBS) 40 that, in turn, comprises a HBS vertical vessel 100 with a conical section 110 for solids to settle, collect, and be removed through the opening hole 120 at the bottom of the conical section 110, and distributors 130 to feed and evenly distribute the wash water being fed at the bottom of the vertical section 100 and above the conical section 110 of the hindered-bed settler 40. The HBS achieves density segregation of solid particles as a result of different settling rates through a fluidized bed of particles comprising mostly high density particles. The vertical section 100 in a HBS 40 further comprises an elutriation column in which heavy particles are fluidized by an upward rise of water that is injected at the bottom of the vertical section 100. A fluidized bed is formed along the height of the elutriation column and separation takes place basically in hindered settling conditions. Particles that have a density greater than the fluidized bed report to the underflow, while the lighter material, which cannot penetrate the bed, report to the overflow. A slurry feed stream 20 with high solid content is preferred by the HBS 40 so that the particles will pack together more tightly in the fluidized bed, thereby generating a greater up-flow velocity between the particles. A slurry feed stream with a high solids content requires less water injection to maintain the up-flow velocity necessary for separation, and this also reduces water consumption. From the HBS 40, wash water and the lighter and smaller particles (including carbon particles) that are separated and "floated" out of the slag slurry stream 20 in the HBS 40 are withdrawn from outlet 70 located at the top of the HBS 40. The stream from the outlet 70 is transported via a conduit to a gravity settler; such as, but not limited to, an inclined-plate lamella settler 80, or a thickener/clarifier (not shown). These types of gravity settler apparatus are known in the art, and serve to concentrate and recover carbon-rich particles that are then recycled back to gasification reactor 10. The water exiting the lamella settler 80 is transported via a conduit to a recycle water tank 90 to be used as wash water for further cycles of elutriation in the HBS 40. According to this embodiment as illustrated in FIG. 1, the overall carbon content of the slag slurry input stream 20 is reduced from greater than 30% to less than 5%, thereby producing a low-carbon, marketable aggregate product.

Figure 2:
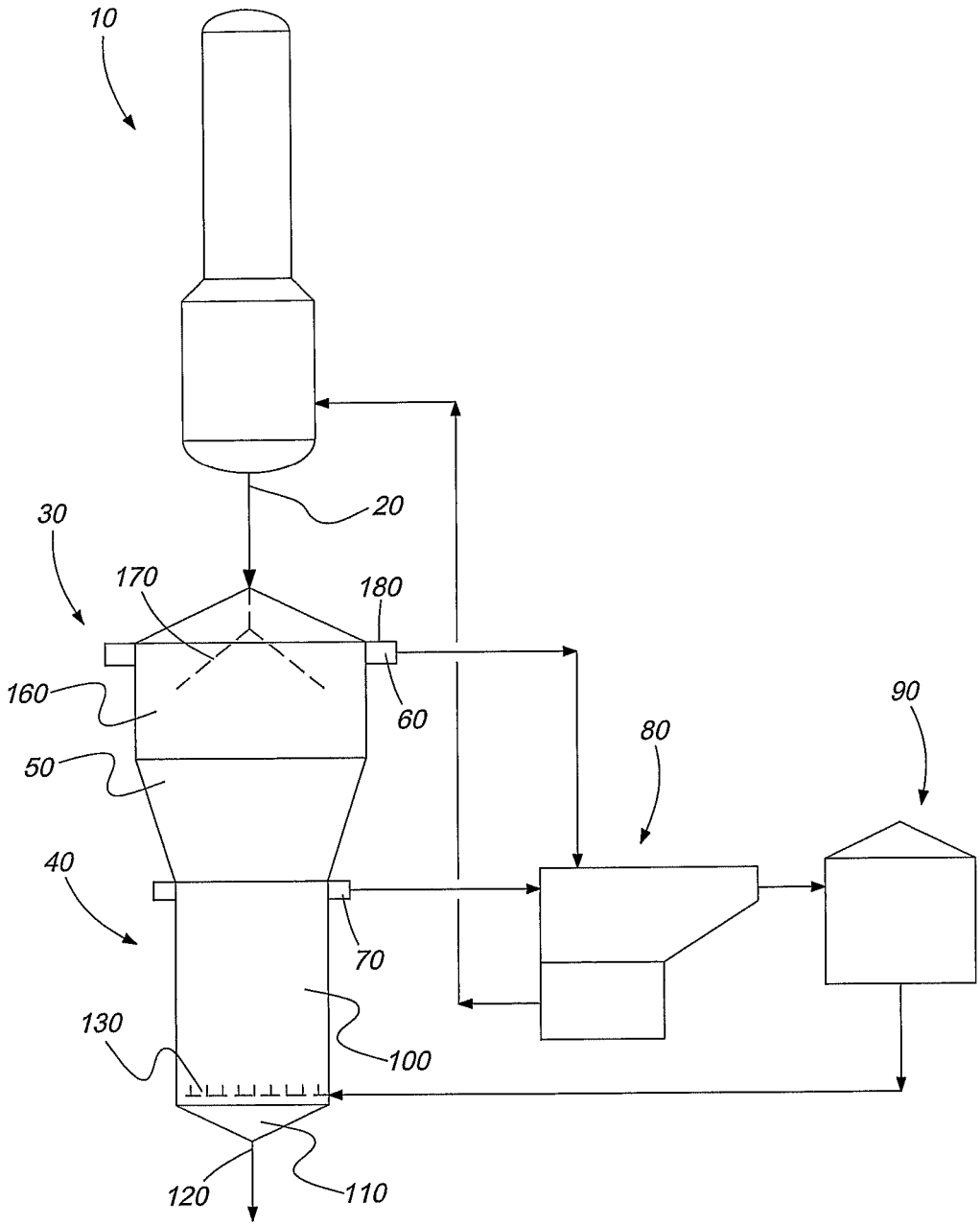
FIG. 2 is a schematic representation of one embodiment of the present invention.

The embodiment depicted in FIG. 2 illustrates a slag handling, beneficiation, carbon recovery/concentration/recycling and water recovery/recycling process and system for the slag produced in a slagging gasification reactor 10. Further referring to FIG. 2, the system comprises primarily a de-waterer; For example, but not limited to, a disengager 30 and an HBS 40. The disengager 30 comprises a vessel 160 with flow distributors 170 on the top part of the vessel 160 to distribute the feed flow evenly across the cross-sectional area of the vessel flowing downwards. The disengager further comprises an overflow weir 180 at the top of the vessel 160. As in FIG. 1, the HBS 40 in the embodiment depicted in FIG. 2 likewise comprises a vertical vessel 100 with a conical section 110 for solids to settle, collect, and be removed through the opening 120 at the bottom of the conical section 110, and distributors 130 to feed and evenly distribute the wash water being fed at the bottom of the vertical section 100 and above the conical section 110 of the HBS 40. As described in FIG. 1, the HBS achieves density segregation of solid particles as a result of different settling rates through a fluidized bed of particles comprising mostly high density particles. As described in FIG. 1, the vertical section 100 in a HBS further comprises an elutriation column in which heavy particles are fluidized by an upward rise of water that is injected at the bottom of the column. A fluidized bed is formed along the height of the column and separation takes place basically in hindered settling conditions. Particles that have a density greater than the fluidized bed migrate downward to the underflow and lighter particles that cannot penetrate the bed migrate upward to the overflow. In the embodiment as illustrated in FIG. 2, the HBS 40 operates in conjunction with a disengager 30 upstream of the HBS 40. A slurry feed stream 20 with high solid content is preferred by the HBS 40 so that the particles will pack together more tightly in the fluidized bed, thereby generating a greater up-flow velocity between the particles. A slurry feed stream with a high solids content requires less water injection to maintain the up-flow velocity necessary for separation, and this also reduces water consumption. The disengager 30 described in this embodiment is an extension of the HBS, and acts to concentrate the slurry feed. The disengager 30 is larger in cross-sectional area than the HBS, and is located above the HBS. A disengager conical section 50 transitions between the disengager 30 and the HBS 40 and connects these two units. The slag slurry stream 20 from the gasifier 10 is large in volume (e.g.1000 gallons per minute) but has a very low solids content (e.g. 1-5% by weight). The slag slurry stream 20 de-gases in the disengager 30, and the gases are collected in the vapor space on the top of the disengager 30, then routed to a flare. Most water and some of the lighter particles are allowed to overflow into the disengager overhead weir outlet 60. The diameter and height of the disengager 30 is designed to prevent particles with a large ash content from being carried by turbulence to the overflow, and also so that these particles have adequate time to settle and enter the HBS 40 below. From the HBS, wash water and the lighter and smaller particles (including carbon particles) are separated as they preferentially rise to the top of the slag slurry stream 20, and these particles are withdrawn from outlet 70 (located at the bottom of the disengager 30 and above the HBS 40). The combined streams from the overflow weir outlet 60 and the outlet 70 are introduced to a gravity settler that may be, but is not limited to, an inclined-plate lamella settler 80, or a thickener-clarifier (not depicted) to concentrate and recover carbon-rich particles. These particles are then recycled back to gasification reactor 10. The water exiting the lamella settler 80 is first conveyed to a recycled water tank 90, then later re-used as wash water in the HBS 40. With this system, the slag slurry stream 20 is concentrated to a desired solid content percentage such that the quantity of wash water required by the hindered-bed settler 40 is minimized. According to the embodiment illustrated in FIG. 2, the slag slurry stream 20 from a gasifier 10 is de-watered and the solid content increased from less than 5% to approximately 30% (by weight) through the disengager 30 before being introduced to the HBS 40. In the HBS, the carbon content is then reduced from greater than 30% to less than 5%, thereby producing a low carbon marketable aggregate product.

Figure 3:
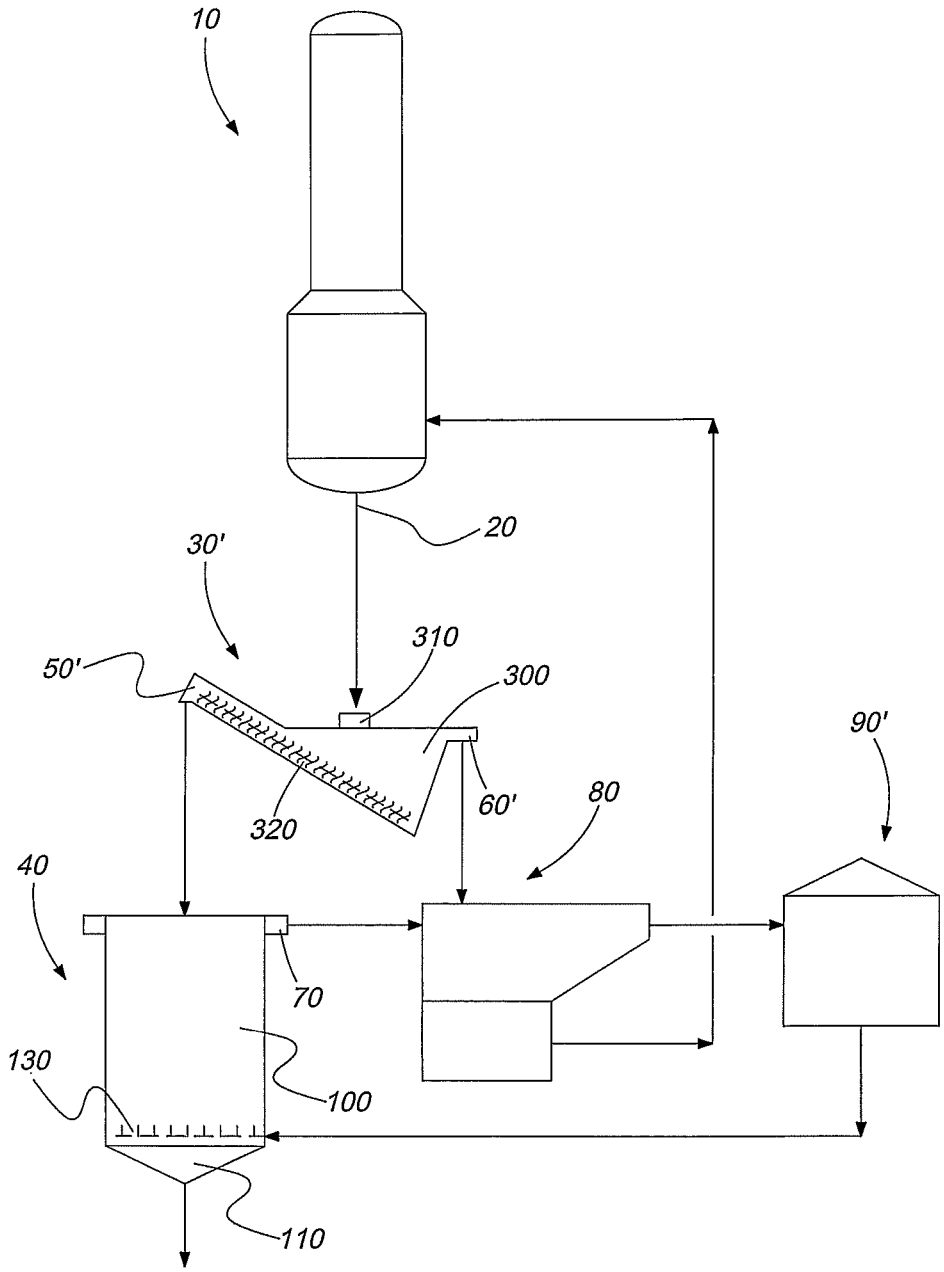
FIG. 3 is a schematic representation of one embodiment of the present invention.

FIG. 3 illustrates an alternative embodiment of the current invention for slag handling, beneficiation, carbon recovery/concentration/recycle, and water recovery/recycling of the slag produced in a gasification reactor. The system depicted in FIG. 3 comprises primarily a spiral de-waterer 30' and a hindered-bed settler 40. The spiral de-waterer 30' comprises essentially an opening trough 300 for sedimentation of solids and a transportation spiral 320 for removal and dewatering of the settled product. The trough 300 is shaped with a conical bottom to facilitate the settling of the solids and removal by the spiral. The inlet flow is evenly spread out through a feed distributor 310. Coarse solids settle and are continuously removed by means of the transport spiral 320. The solids are then de-watered by gravity drainage in the upper portion of the spiral, followed by discharge of the through outlet 50', dropping into the HBS 40 below. The HBS comprises a vertical vessel 100 with a conical bottom 110 for solids to settle, collect, and be removed through the orifice at the bottom of the conical section, and distributors 130 to feed and evenly distribute the wash water being fed at the bottom of the vertical section 100 and above the conical section 110 of the HBS 40. The HBS in this embodiment functions similarly to the embodiments depicted in FIGS. 1 and 2. In the embodiment as illustrated in FIG. 3, the HBS 40 operates in conjunction with a concentrator such as spiral de-waterer 30' upstream of the HBS 40. Either a dry feed of solids, or a slurry feed stream with high solid content is preferred because a slurry feed stream with a high solids content requires less water injection to maintain the up-flow velocity necessary for separation, and this also reduces water consumption. The dewatered solid discharged from the spiral de-waterer 30' is an ideal feedstock for the HBS 40. The slag slurry stream 20 from the gasifier 10 is large in volume (e.g. 1000 gallons per minute) but has a very low solids content (e.g. 1-5% by weight). The slag slurry stream 20 de-gasses in the spiral de-waterer 30', and the offgas is collected in the enclosed vapor space on the top of the spiral de-waterer 30', then routed to a flare. Most water and some of the lighter particles rise and are allowed to flow to the outlet 60', while most of the solids settle and are fed to the HBS 40 through outlet 50' of the spiral de-waterer 30'. The water from the outlet 60' is introduced to a gravity settler, such as, but not limited to, an inclined-plate lamella settler 80 or a thickener/clarifier. This step serves to concentrate and recover the carbon-rich solids that exit from an outlet near the bottom of the gravity settler, and are then conveyed in a conduit back to gasifier 10. The water exiting lamella settler 80 are then introduced to a recycled water tank 90 for re-use as wash water for the HBS.

Using this system, the slag slurry stream 20 is concentrated to an essentially dry solid so that the amount of wash water required by the HBS 40 is minimized. According to the embodiment as illustrated in FIG. 3, the slag slurry stream 20 from a gasifier 10 is de-watered and the solids content increases from less than 5% to more than 70% when exiting the spiral de-waterer 30'. The HBS then processes these de-watered solids to reduce the carbon content from greater than 30% to less than 5%, thereby producing a low-carbon marketable aggregate product.

The spiral de-waterer 30' as depicted in FIG. 3 relieves the plugging and erosion concerns caused by other de-waterer devices (such as dewatering screens or a hydrocyclone), and in addition, delivers a solids stream free of excess water. The spiral de-waterer typically provides a continuous and fully-automated operation.

Utilizing the methods and systems disclosed herein, the quality of slag aggregate produced by a gasification reactor can be improved to create a marketable product. An added financial benefit is that this improved slag aggregate can be sold for a profit, rather than disposed of in a landfill at a significant cost. In addition, the proposed system increases efficiency by operating continuously, thereby reducing the amount of operator attention required as compared to current methods that involve batch-wise slag collection systems. Carbon conversion efficiency is also increased through the recovery and recycling of particles with a high percentage of unutilized carbon, thereby improving the conversion efficiency of the gasification process. Finally, the current invention should normally be less expensive to implement than currently-utilized batch-wise methodology, thereby lowering the capital cost of the new gasification projects.

EXAMPLES

The following examples are intended to be illustrative of the present invention and to teach one of ordinary skill in the art to make and use the invention. These examples are not intended to limit the invention in any way.

The following Examples 1 and 2 were conducted utilizing a 9"W×9"L×30"H rectangular bench-scale hinder-bed-settler (HBS). The gasification slag samples used were obtained from a commercial gasification facility. All percentages are by weight, unless noted otherwise.

Example 1

A slag aggregate containing 43.5% carbon was slurried with water to a concentration of 7.9% solids and fed to the HBS at 5 gpm, while a counter-current of wash water was pumped at a rate of 2 gpm into the bottom of the HBS. Without screening the sample, approximately 69% of the mineral content in the original slag was recovered in the product, which contained 3.9% carbon. Prior to addition to the HBS, a portion of the slag was sized by mesh screening into several samples with various particle distribution to obtain samples with a number of different size distributions (see TABLE 1, column one). The carbon content of these screened samples indicates that the sample with the lowest carbon content was screened through 65×100 mesh, and that the carbon content of this sized sample was still around 20%. Thus, the mesh screening technique alone did not successfully reduce the carbon content of any sample to less than 5% of total carbon content. However, following processing of the screened samples in the HBS, the carbon content of the slaf aggregate recovered from the underflow fraction was less than 5% in all but one sample containing the largest aggregate particles (Column 7).

TABLE 1

| | Feed | | Overflow | | Underflow | |
|---|---|---|---|---|---|---|
| Mesh Size | Wt. (%) | LOI (%) | Wt. (%) | LOI (%) | Wt. (%) | LOI (%) |
| ≥28 | 21.66 | 70.97 | 10.96 | 79.74 | 54.19 | 4.71 |
| 28 × 48 | 22.76 | 52.94 | 27.75 | 74.22 | 28.49 | 2.55 |
| 48 × 65 | 8.76 | 38.74 | 8.70 | 66.65 | 9.04 | 0.56 |
| 65 × 100 | 10.68 | 20.03 | 7.85 | 53.17 | 6.46 | 0.14 |
| 100 × 325 | 16.52 | 24.42 | 20.45 | 22.57 | 1.60 | 1.47 |
| ≤325 | 19.62 | 33.31 | 24.28 | 32.18 | 0.23 | 19.43 |
| Feed | | 43.52 | | 68.97 | | 3.86 |

| | | | |
|---|---|---|---|
| Feed Percent Solids | 7.91 | Overall Mass Yield | 39.09 |
| Overflow Percent Solids | 4.28 | LOI | 3.86 |

Example 2

A slag aggregate containing 31.6% carbon was slurried with water to 17.4% solids content and fed to the HBS at 5 gpm, while a counter-current of wash water was pumped at a rate of 1 gpm into the bottom of the HBS. Approximately 69% of the mineral content in the original slag was recovered in the product which contained 7.8% carbon. Again the carbon distribution in the original slag indicates that the screen size with the lowest carbon content would be 65-100 mesh, and the carbon content would still be 15.3%. Therefore utilizing a screening technique alone, it would not be possible to reduce the carbon content of any size fraction to less than 5% total carbon content.

Without screening the sample, approximately 69% of the mineral content in the original slag was recovered in the product, which contained 7.8% carbon. Again, the carbon content of screened samples indicates that the sample with the lowest carbon content was screened through 65×100 mesh, and that the carbon content of this sized sample was still around 15.3%. Thus, the mesh screening technique alone did not successfully reduce the carbon content of any sample to less than 5% of total carbon content. However, following processing of the screened samples in the HBS, the carbon content of the slag aggregate collected from the underflow fraction was less than 5% in fractions that had been pre-screened with 48×65, 65×100, and 100×325 mesh. (Column 7).

TABLE 2

| | Feed | | Overflow | | Underflow | |
|---|---|---|---|---|---|---|
| Mesh Size | Wt. (%) | LOI (%) | Wt. (%) | LOI (%) | Wt. (%) | LOI (%) |
| ≥28 | 51.55 | 35.27 | 5.04 | 85.39 | 66.48 | 14.44 |
| 28 × 48 | 20.72 | 27.07 | 21.14 | 77.93 | 18.95 | 7.30 |
| 48 × 65 | 6.91 | 16.75 | 8.26 | 74.46 | 5.18 | 2.52 |
| 65 × 100 | 6.23 | 15.34 | 8.80 | 69.61 | 5.47 | 0.32 |
| 100 × 325 | 7.82 | 15.93 | 19.96 | 32.09 | 3.48 | 0.41 |
| ≤325 | 6.77 | 32.34 | 36.80 | 29.48 | 0.45 | 26.25 |
| Feed | | 31.59 | | 52.79 | | 7.80 |

| | | | |
|---|---|---|---|
| Feed Percent Solids | 17.36 | Overall Mass Yield | 47.13 |
| Overflow Percent Solids | 2.71 | LOI | 7.80 |

Examples 3 and 4 describe experiments conducted in a 9"W×16"L×4.5 ft. H rectangular pilot-scale HBS. A dilute slag slurry stream was concentrated using a 6"(i.d.)×6 ft. tall hydrocyclone. The concentrated slag was the fed into the HBS.

Example 3

Referring to TABLE 3, A slag containing 87.1% carbon in a dilute slurry stream containing 3.2% solids was fed to a hydrocyclone at 74 gpm. The slurry was concentrated to 9.2% solids in the underflow of the hydrocyclone with a underflow output rate of 24.2 gpm. This outflow was next fed to the HBS with 8.6 gpm of counter-current wash water flowing into the bottom of the HBS. Approximately 68.6% of the solids content of the slag aggregate (and 55.6% of the mineral content) was recovered in the final product, which contained just 1.5% carbon. Processing of mesh-screened samples was likewise successful in producing a final product containing less than 5% carbon content for most samples.

TABLE 3

| | Feed | Cyclone Overflow | Cyclone Underflow | Teeter Water | Separator Overflow | Separator Underflow |
|---|---|---|---|---|---|---|
| Flow (gpm) | 74.0 | 49.8 | 24.2 | 8.6 | 32.8 | — |
| % Solids | 3.2% | 0.1% | 9.2% | 0.0% | 6.3% | 68.6% |
| Carbon Content | | | | | | |
| Feed | 87.1% | 100% | 86.9% | — | 95.4% | 1.5% |
| +28 | 12.9% | — | 13.1% | — | 5.2% | 84.1% |
| 28 × 48 | 36.0% | — | 36.7% | — | 49.1% | 12.0% |

TABLE 3-continued

| | Feed | Cyclone Overflow | Cyclone Underflow | Teeter Water | Separator Overflow | Separator Underflow |
|---|---|---|---|---|---|---|
| 48 × 60 | 14.4% | — | 14.7% | — | 12.2% | 2.1% |
| 60 × 100 | 21.9% | — | 22.3% | — | 20.1% | 1.5% |
| 100 × 325 | 12.9% | — | 12.2% | — | 11.8% | 0.2% |
| −325 | 1.9% | — | 1.0% | — | 1.6% | 0.0% |
| +28 | 46.3% | — | — | — | 98.7% | 0.6% |
| 28 × 48 | 95.2% | — | — | — | 98.8% | 7.7% |
| 48 × 60 | 95.7% | — | — | — | 97.7% | 0.6% |
| 60 × 100 | 94.6% | — | — | — | 94.2% | 0.4% |
| 100 × 325 | 89.5% | — | — | — | 86.5% | 3.8% |
| −325 | 44.3% | — | — | — | 43.7% | 0.0% |
| Solids, lb/hr | 1166 | 22.4 | 1111 | | 1027 | 84.9 |
| Mineral Ash, lb/hr | 150.5 | | 146.2 | | 47.2 | 83.6 |
| Mineral Recov. % | | | | | | 55.6% |

Example 4

A slag containing 71.5% carbon in a slurry stream containing 2.3% solid was fed to the hydrocyclone at 58.6 gpm. The slurry was concentrated to 7.1% solid in the underflow of the hydrocyclone with an underflow output rate of 18.0 gpm. This was fed to the HBS with 14.5 gpm of counter-current wash water to the bottom of the HBS. Approximately 80.3% of the mineral content in the original slag aggregate material was recovered in the final product, which contained just 3.0% carbon. Processing of mesh-screened samples was likewise successful in producing a final product containing less than 5% carbon content for most samples.

TABLE 4

| | Feed | Cyclone Overflow | Cyclone Underflow | Teeter Water | Separator Overflow | Separator Underflow |
|---|---|---|---|---|---|---|
| Flow (gpm) | 58.6 | 40.6 | 18.0 | 14.5 | 32.5 | — |
| % Solids | 2.3% | 0.1% | 7.1% | 0.0% | 3.0% | 59.3% |
| Carbon Content | | | | | | |
| Feed | 71.5% | 100.0% | 71.1% | — | 94.7% | 3.0% |
| +28 | 22.2% | — | 22.5% | — | 1.8% | 89.2% |
| 28 × 48 | 30.7% | — | 31.2% | — | 31.6% | 8.2% |
| 48 × 60 | 11.9% | — | 12.1% | — | 17.9% | 1.4% |
| 60 × 100 | 21.7% | — | 22.0% | — | 30.2% | 0.9% |
| 100 × 325 | 12.3% | — | 11.7% | — | 17.1% | 0.3% |
| −325 | 1.2% | — | 0.4% | — | 1.4% | 0.0% |
| Carbon Content | | | | | | |
| +28 | 15.3% | — | — | — | 94.4% | 3.1% |
| 28 × 48 | 88.6% | — | — | — | 97.8% | 1.0% |
| 48 × 60 | 90.8% | — | — | — | 98.1% | 2.1% |
| 60 × 100 | 89.0% | — | — | — | 96.8% | 0.5% |
| 100 × 325 | 83.6% | — | — | — | 86.2% | 2.2% |
| −325 | 39.7% | — | — | — | 43.6% | 6.9% |
| Solids, lb/hr | 661.1 | 10.1 | 635.4 | | 479.4 | 155.9 |
| Mineral Ash, lb/hr | 188.4 | | 183.9 | | 25.4 | 151.3 |
| Mineral Recov. % | | | | | | 80.3% |

The scope of protection is not limited by the description and examples provided herein, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention.

We claim:

1. A system comprising:

a) a gasification reactor for producing synthesis gas and slag;

b) a de-waterer for concentrating said slag produced by said gasification reactor into a concentrated slag stream and a first overflow stream;

c) a hindered-bed settler for fluidizing and segregating said concentrated slag stream into a second overflow stream containing carbon particles and an underflow stream;

c) a gravity settler for separating said first and second overflow streams into a carbon stream as a second underflow and wash water; and d) a recycled water tank for storing said wash water from said gravity settler; and e) flow conduits for recycling, said second underflow to said gasification reactor and said wash water to said hindered-bed settler.

2. The system according to claim 1, wherein said de-waterer is a disengager comprising:

a) a disengager vessel for settling and concentrating said slag product into the concentrated slag stream and the first overflow stream;

b) a flow distributor for evenly distributing said slag across said disengager vessel; and c) an overflow weir for removing said first overflow stream from said disengager vessel.

3. The system according to claim 1, wherein said underflow stream in said hinder-bed settler has a carbon content less than 5% w/v.

4. The system according to claim 1, wherein said de-waterer is a spiral de-waterer comprising:

a) an open trough that allows sedimentation of solids from said slag;

b) a transportation spiral for removing and dewatering settled said solids; and c) a feed distributor for evenly spreading said slag into said open trough, wherein said spiral dewaterer is configured to continuously remove and dewater said solids by said transportation spiral and drainage in an upper part of said transportation spiral, the removed and dewatered solids being the concentrated slag stream.

5. A system comprising:

a) a gasification reactor for producing synthesis gas and slag;

b) a de-waterer for concentrating said slag produced by said gasification reactor into a concentrated slag stream and a first overflow stream containing particles;

c) a hindered-bed settler for fluidizing and segregating said concentrated slag stream into a second overflow stream containing carbon particles and an underflow stream;

c) a gravity settler for separating said first and second overflow streams into a carbon stream as a second underflow and wash water; and d) a recycled water tank for storing said wash water from said gravity settler.

6. The system of claim 5, further comprising e) flow conduits for recycling said second underflow to said gasification reactor and said wash water to said hindered-bed settler.

7. The system according to claim 5, wherein said de-waterer is a disengager comprising:

a) a disengager vessel for settling and concentrating said slag product into the concentrated slag stream and the first overflow stream;

b) a flow distributor for evenly distributing said slag across said disengager vessel; and c) an overflow weir for removing said first overflow stream from said disengager vessel.

8. The system according to claim 5, wherein said underflow stream in said hinder-bed settler has a carbon content less than 5% w/v.

9. The system according to claim 5, wherein said de-waterer is a spiral de-waterer comprising:

a) an open trough that allows sedimentation of solids from said slag;

b) a transportation spiral for removing and dewatering settled said solids; and c) a feed distributor for evenly spreading said slag into said open trough.

* * * * *